US010833432B2

(12) United States Patent
Paynter et al.

(10) Patent No.: US 10,833,432 B2
(45) **Date of Patent: *Nov. 10, 2020**

(54) EASILY ASSEMBLED COAXIAL CABLE AND CONNECTOR WITH REAR BODY

(71) Applicant: CommScope Technologies LLC, Hickory, NC (US)

(72) Inventors: Jeffrey D. Paynter, Momence, IL (US); Ronald A. Vaccaro, Taylorsville, NC (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/707,403

(22) Filed: Dec. 9, 2019

(65) Prior Publication Data

US 2020/0119469 A1 Apr. 16, 2020

Related U.S. Application Data

(63) Continuation of application No. 15/946,935, filed on Apr. 6, 2018, now Pat. No. 10,505,294, which is a (Continued)

(51) Int. Cl.
*H01R 9/05* (2006.01)
*H01R 24/56* (2011.01)

(52) U.S. Cl.
CPC ..... *H01R 9/0521* (2013.01); *H01R 24/564* (2013.01)

(58) Field of Classification Search
CPC ..... H01R 9/0521
(Continued)

(56) References Cited

U.S. PATENT DOCUMENTS 3,668,612 A 6/1972 Nepovim
3,963,320 A 6/1976 Spinner
(Continued)

FOREIGN PATENT DOCUMENTS

WO 2007/103463 9/2007

OTHER PUBLICATIONS

Extended European Search Report corresponding to European Application No. 16862792.5 dated May 21, 2019.
(Continued)

*Primary Examiner* — Neil Abrams
(74) *Attorney, Agent, or Firm* — Myers Bigel, P.A.

(57) ABSTRACT

A coaxial cable-connector assembly comprising: (a) a coaxial cable; (b) a coaxial connector; (c) a rear body; and (d) a coupling nut. The coaxial cable comprises: an inner conductor; a dielectric layer circumferentially surrounding the inner conductor; an outer conductor circumferentially surrounding the dielectric layer; and a jacket circumferentially surrounding the outer conductor. The coaxial connector comprises: an inner contact electrically connected with the inner conductor; an outer body spaced apart from and circumferentially surrounding the inner contact; and a dielectric spacer interposed between the inner contact and the outer body. The rear body has a main section, a rear collet extending rearwardly from the main section, and a front engagement structure that coordinates with the outer body to engage the outer conductor. The nut has a threaded section and a tapered inner surface. Engagement of the nut with a threaded section on one of the rear body and the outer body advances the nut forwardly so that the tapered inner surface of the nut deflects the rear collet to engage the cable jacket.

16 Claims, 12 Drawing Sheets

Related U.S. Application Data continuation of application No. 15/340,210, filed on Nov. 1, 2016, now Pat. No. 9,941,609.

(60) Provisional application No. 62/251,512, filed on Nov. 5, 2015, provisional application No. 62/316,892, filed on Apr. 1, 2016.

(58) Field of Classification Search
USPC ..... 439/583, 584, 578
See application file for complete search history.

(56) References Cited

U.S. PATENT DOCUMENTS

| | | | | |
|---|---|---|---|---|
| 4,676,577 | A | 6/1987 | Szegda | |
| 5,267,877 | A | 12/1993 | Scannelli et al. | |
| 5,938,474 | A | 8/1999 | Nelson | |
| 6,331,123 | B1 | 12/2001 | Rodrigues | |
| 7,351,101 | B1 | 4/2008 | Montena | |
| 7,927,135 | B1 | 4/2011 | Wlos | |
| 8,011,955 | B1 | 9/2011 | Lu | |
| 8,038,472 | B2 | 10/2011 | Montena et al. | |
| 8,047,870 | B2 * | 11/2011 | Clausen | H01R 24/564 439/578 |
| 8,113,878 | B2 * | 2/2012 | Clausen | H01R 24/564 439/584 |
| 8,323,056 | B2 | 12/2012 | Clausen | |
| 8,449,325 | B2 | 5/2013 | Wild et al. | |
| 8,460,031 | B2 | 6/2013 | Paynter et al. | |
| 9,147,963 | B2 | 9/2015 | Balcer et al. | |
| 9,270,046 | B2 * | 2/2016 | Natoli | H01R 13/52 |
| 9,276,363 | B2 * | 3/2016 | Wild | H01R 9/0521 |
| 9,941,609 | B2 * | 4/2018 | Paynter | H01R 9/0521 |
| 10,505,294 | B2 * | 12/2019 | Paynter | H01R 9/0521 |
| 2006/0003563 | A1 | 1/2006 | Buenz et al. | |
| 2010/0178800 | A1 | 7/2010 | Clausen | |
| 2010/0190377 | A1 | 7/2010 | Islam | |
| 2012/0149239 | A1 | 6/2012 | Clausen | |
| 2013/0244484 | A1 | 9/2013 | Wild et al. | |
| 2014/0045356 | A1 | 2/2014 | Natoli et al. | |
| 2014/0134878 | A1 | 5/2014 | Van Swearingen et al. | |

OTHER PUBLICATIONS

Notification Concerning Transmittal of International Preliminary Report on Patentability corresponding to International Application No. PCT/US2016/059897; dated May 17, 2018.

Notification of Transmittal of the International Search Report and the Written Opinion of the International Searching Authority, or the Declaration corresponding to International Application No. PCT/US2016/059897; dated Jan. 24, 2017.

* cited by examiner

EASILY ASSEMBLED COAXIAL CABLE AND CONNECTOR WITH REAR BODY

RELATED APPLICATIONS

The present application is a continuation of and claims priority to U.S. patent application Ser. No. 15/946,935, filed Apr. 6, 2018, now U.S. Pat. No. 10,505,294, which is a continuation of and claims priority to U.S. patent application Ser. No. 15/340,210, filed Nov. 1, 2016, now U.S. Pat. No. 9,941,609, which claims priority from and the benefit of U.S. Provisional Patent Application Nos. 62/251,512, filed Nov. 5, 2015, and 62/316,892, filed Apr. 1, 2016, the disclosures of each of which are hereby incorporated herein by reference in full.

FIELD OF THE INVENTION

The present invention is directed generally to electrical cable connectors, and more particularly to coaxial connectors for electrical cable.

BACKGROUND

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an electronic apparatus or on another cable. Typically, one connector will include a structure such as a pin or post connected to an inner conductor of the coaxial cable and an outer conductor connector body connected to the outer conductor of the coaxial cable these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

Passive Intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire RF system. Thus, the reduction of PIM via connector design is typically desirable.

SUMMARY

As a first aspect, embodiments of the invention are directed to a coaxial cable-connector assembly comprising: (a) a coaxial cable; (b) a coaxial connector; (c) a rear body; and (d) a coupling nut. The coaxial cable comprises: an inner conductor, a dielectric layer circumferentially surrounding the inner conductor, an outer conductor circumferentially surrounding the dielectric layer; and a jacket circumferentially surrounding the outer conductor. The coaxial connector comprises: an inner contact electrically connected with the inner conductor; an outer body spaced apart from and circumferentially surrounding the inner contact; and a dielectric spacer interposed between the inner contact and the outer body. The rear body has a main section, a rear collet extending rearwardly from the main section, and a front engagement structure that coordinates with the outer body to engage the outer conductor. The nut has a threaded section and a tapered inner surface. Engagement of the nut with a threaded section on one of the rear body and the outer body advances the nut forwardly so that the tapered inner surface of the nut deflects the rear collet to engage the cable jacket.

As a second aspect, embodiments of the invention are directed to a coaxial cable-connector assembly comprising: (a) a coaxial cable; (b) a coaxial connector; (c) a rear body; and (d) a coupling nut. The coaxial cable comprises: an inner conductor; a dielectric layer circumferentially surrounding the inner conductor; an outer conductor circumferentially surrounding the dielectric layer; and a jacket circumferentially surrounding the outer conductor. The coaxial connector comprises: an inner contact electrically connected with the inner conductor; an outer body spaced apart from and circumferentially surrounding the inner contact; and a dielectric spacer interposed between the inner contact and the outer body. The rear body has a main section, a rear collet extending rearwardly from the main section, and a front engagement structure that coordinates with the outer body to engage the outer conductor. The coupling nut has a threaded section. Engagement of the nut with a threaded section on one of the rear body and the outer body forces the front engagement structure to crush a corrugation of the outer conductor against the outer body.

As a third aspect, embodiments of the invention are directed to a coaxial cable-connector assembly comprising: (a) a coaxial cable; (b) a coaxial connector; (c) a rear body; and (d) a coupling nut. The coaxial cable comprises: an inner conductor, a dielectric layer circumferentially surrounding the inner conductor; an outer conductor circumferentially surrounding the dielectric layer; and a jacket circumferentially surrounding the outer conductor. The coaxial connector comprises: an inner contact electrically connected with the inner conductor; an outer body spaced apart from and circumferentially surrounding the inner contact; and a dielectric spacer interposed between the inner contact and the outer body. The rear body has a main section, a rear collet extending rearwardly from the main section, and a front engagement structure that coordinates with the outer body to engage the outer conductor, the front engagement structure having a ramp that engages a flared end of the outer conductor. The coupling nut has a threaded section, wherein engagement of the nut with a threaded section on one of the rear body and the outer body advances the nut forwardly so that ramp compresses the flared end into the outer body.

DETAILED DESCRIPTION

Figure 1:
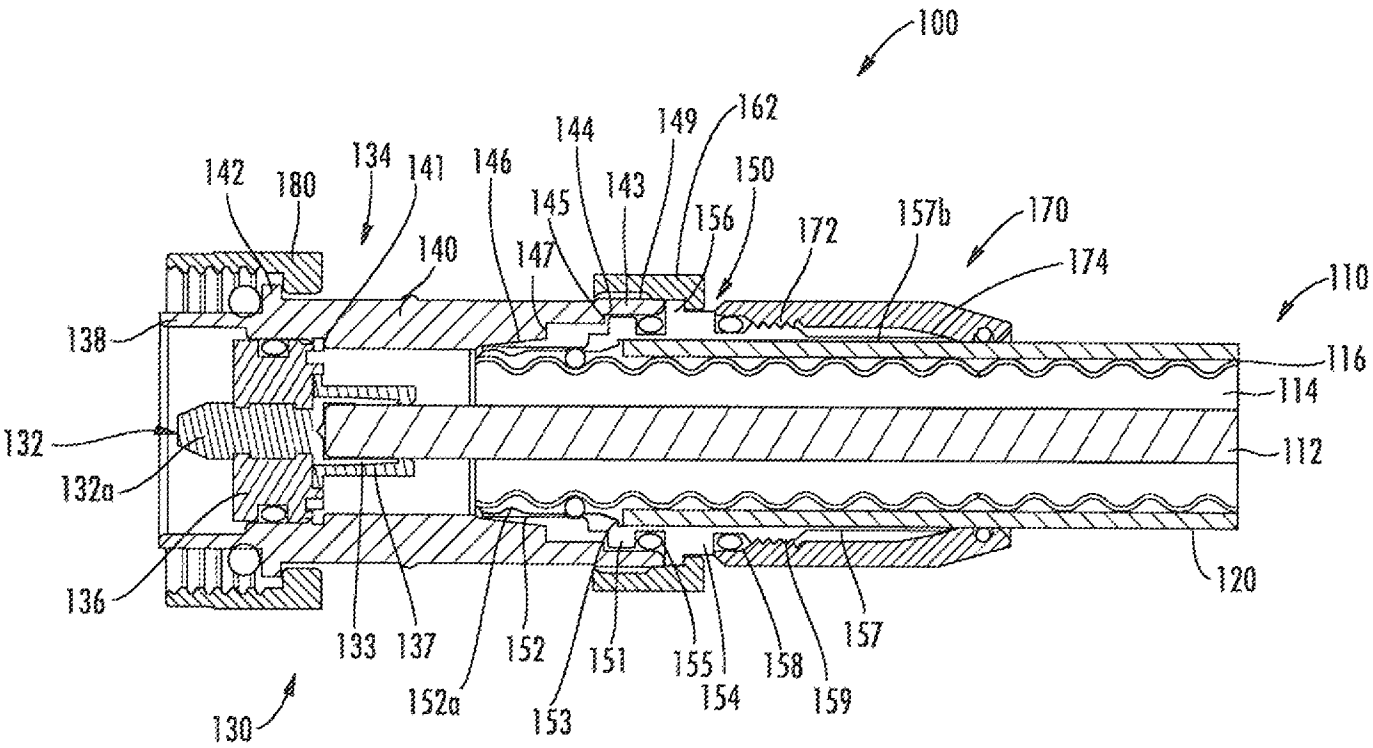
FIG. 1 is a section view of a coaxial connector-cable assembly according to embodiments of the invention.
Figure 2:
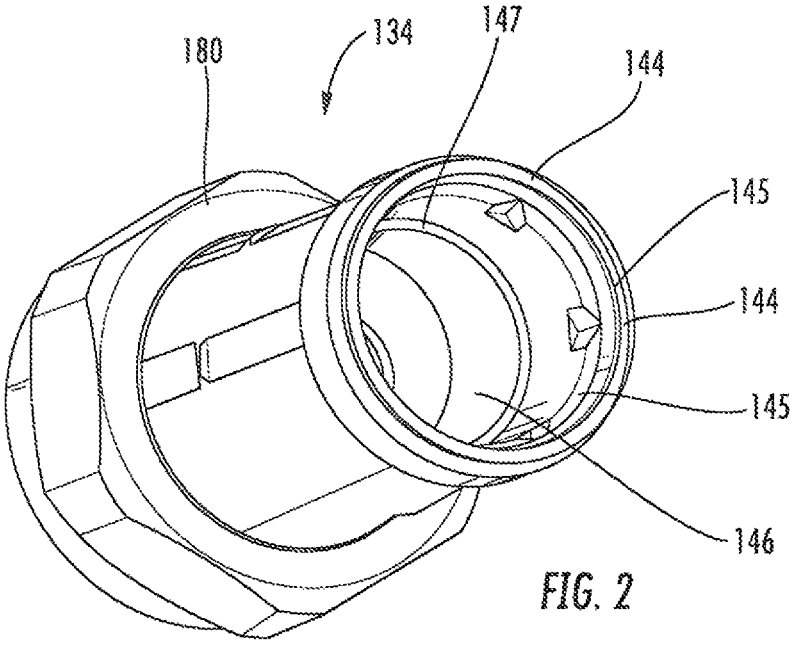
FIG. 2 is a perspective view of the outer body and coupling nut of the connector of FIG. 1.
Figure 3:
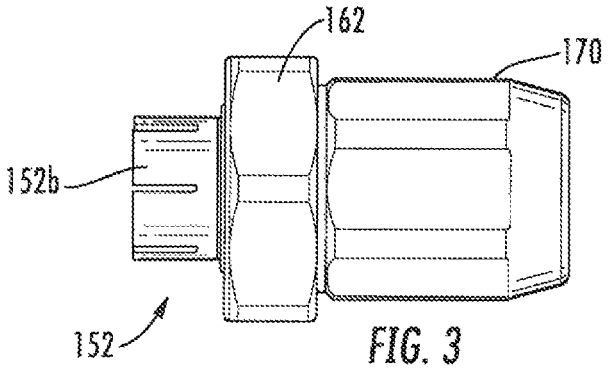
FIG. 3 is a side view of the rear body and polymer nut of the assembly of FIG. 1.

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Referring now to the drawings, a coaxial connector-assembly, designated broadly at 100, is shown in FIGS. 1-8. The assembly 100 includes a coaxial cable 110 and a connector 130 attached to one end thereof via a rear body 150 and a polymeric nut 170. The cable 110 includes a central conductor 112, a dielectric layer 114 that circumferentially overlies the central conductor 112, an annularly corrugated outer conductor 116 that circumferentially overlies the dielectric layer 114, and a polymeric cable jacket 120 that circumferentially overlies the outer conductor 116. These components will be well-known to those of skill in this art and need not be described in detail herein.

The connector 130 includes an inner contact 132, an outer body 134, a dielectric spacer 136, and an insulator 137. The inner contact 132 has a generally cylindrical post 132*a* and is mounted on and is in electrical contact with the central conductor 112 of the cable 110 via a spring basket 133. The insulator 137 surrounds and protects the spring basket 133. The dielectric spacer 136 is positioned radially outwardly of the post 132*a*.

The outer conductor body 134 includes a mating ring 138 that is configured to mate with the outer conductor body of a mating jack. The mating ring 138 extends forwardly of a main sleeve 140. A flange 142 extends radially outwardly of the main sleeve 140 and provides a bearing surface for a nut 180. A shoulder 141 is located on the inner surface of the main sleeve 140 to provide a mounting location for the dielectric spacer 136. At its rearward end, the main sleeve 140 has a tail 143. A shoulder 145 with a hexagonal broach 144 is located forwardly of the tail 143 (see FIG. 2). A tapered surface 146 extends between a second shoulder 147 and a forward portion of the inner surface of the main sleeve 140. A threaded section 149 is located on the outer surface of the tail 143.

The rear body 150 includes a front collet 152 that extends forwardly from a main section 154. The front collet 152 comprises a series of fingers 152*b*, each of which includes a nub 152*a* on its inner surface. The main section 154 includes an O-ring recess 155. A shoulder 153 is located on the inner surface of the main section 154 between the front collet 152 and the recess 155. A hexagonal ring 151 is located forwardly of the recess 155. A flange 156 extends radially outwardly from the main section 154 just rearwardly of the recess 155 to provide a bearing surface for a nut 162. Another O-ring recess 158 is located rearwardly of the flange 156. A threaded area 159 is located on the outer surface of the main section 154 rearwardly of the O-ring recess 158. A rear collet 157 (which includes a series of fingers 157*b*) extends rearwardly from the main section 154.

The polymeric nut 170 is elongate and includes a threaded section 172 on the forward end of its inner surface. The inner surface 174 is tapered radially inwardly at the rear end of the nut 170.

Figure 4:
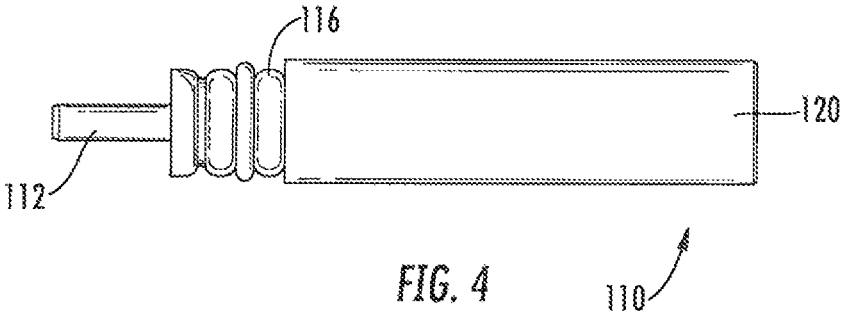
FIG. 4 is a side view of the cable of the assembly of FIG. 1 at the beginning of the assembly process.

Assembly of the cable-connector assembly 100 commences with the preparation of the cable 110, which comprises stripping the jacket 120 to expose a portion of the outer conductor 116. Additionally, the outer conductor 116 and dielectric layer 114 are stripped to expose the end of the inner conductor 112 (FIG. 4).

Figure 5:
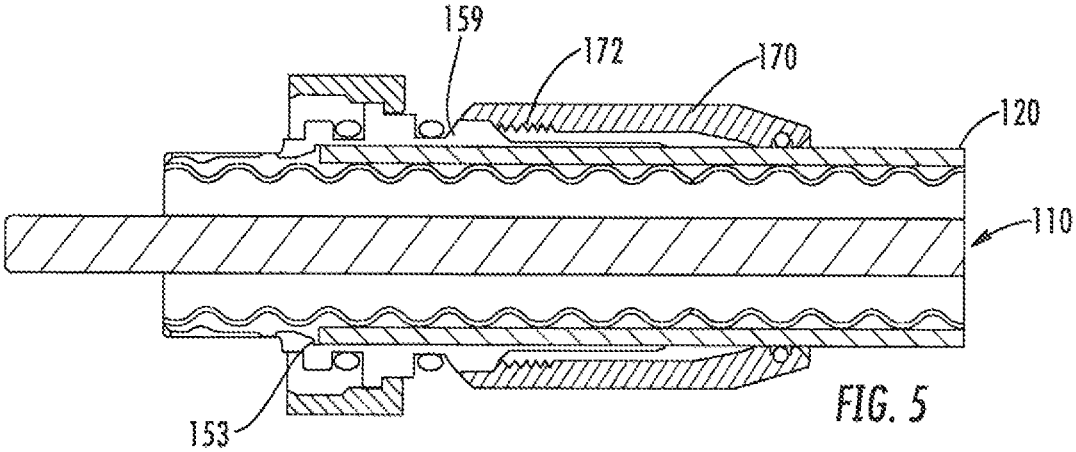
FIG. 5 is a side section view of the cable of FIG. 4 with the rear body and polymer nut of FIG. 3 slipped thereon.

A subassembly comprising the polymeric nut 170 and the rear body 150 (with its nut 162) is then slipped over the end of the cable 110. As can be seen in FIG. 5, the nut 170 is positioned with the threaded section 172 rearwardly of but adjacent to the threaded area 159 of the rear body 150. The subassembly slides along the cable 110 until the end of the jacket 120 "bottoms out" against the shoulder 153 of the rear body 153.

Figure 6:
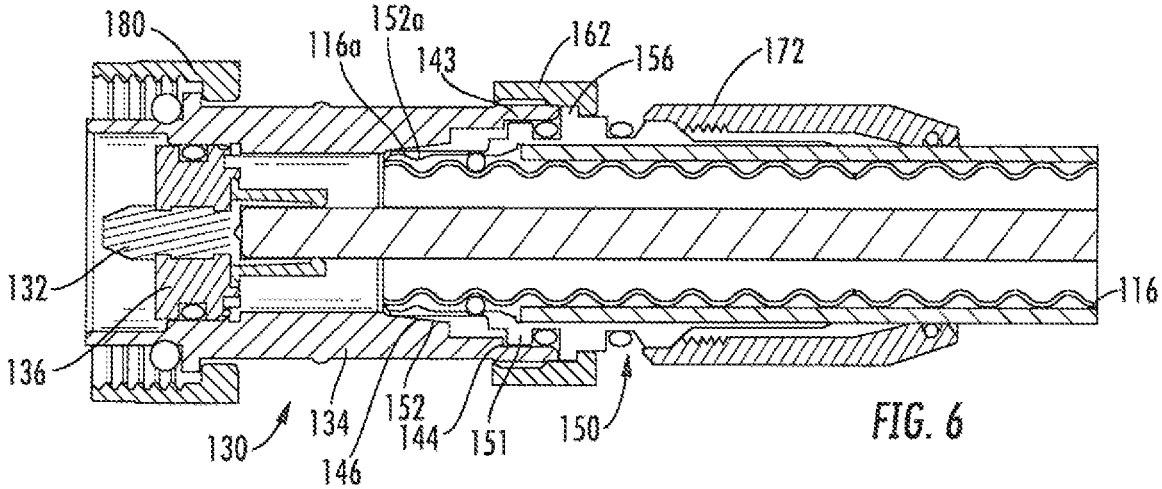
FIG. 6 is a side section view of the cable, rear body and polymer nut of FIG. 5 with the connector of FIG. 1 slipped onto the cable.

The connector 130 comprising the outer body 134, the dielectric spacer 136, the inner contact 132 and the coupling nut 180 is then slipped over the end of the cable 110 with the tail 143 being inserted inside the nut 162 (FIG. 6). The connector 130 is aligned relative to the rear body 150 by the mating interaction between the hexagonal broach 144 of the outer body 134 and the hexagonal ring 151 of the rear body 150. The nut 162 is tightened, which forces the rear body 150 forwardly relative to the outer body 134. The forward movement of the rear body 150 forces the front collet 152 into the tapered surface 146 of the outer body 134, which deflects the front collet 152 radially inwardly into contact with the outer conductor 116. The nubs 152*a* of the front collet 152 are forced into the endmost "valley" 116*a* of the corrugations of the outer conductor 116 to maintain the rear body 150 in place relative to the outer conductor 116. Tightening ceases when the tail 143 of the outer body 134 contacts the flange 156 of the rear body 150.

Figure 7:
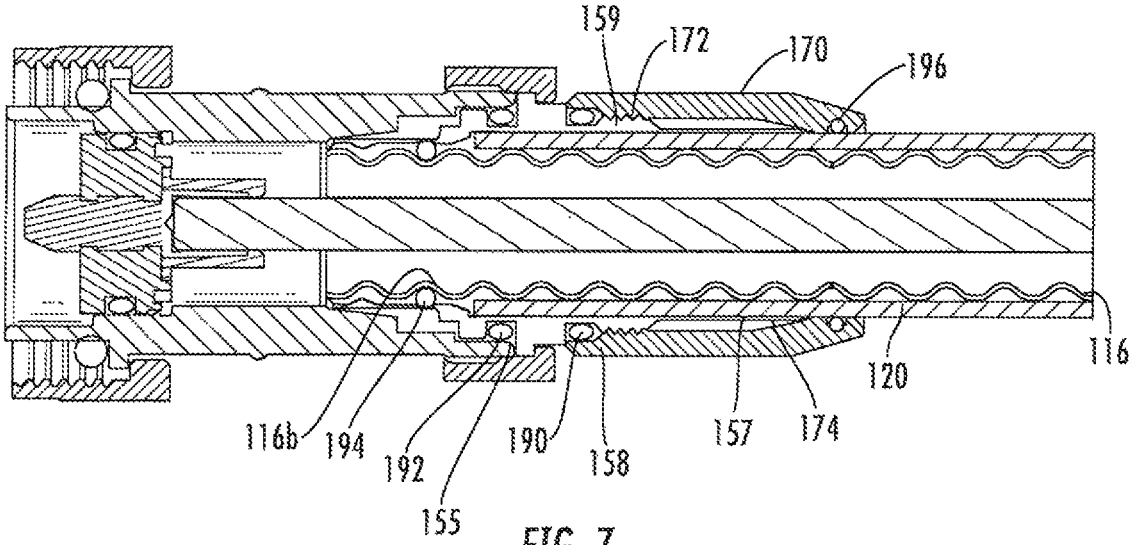
FIG. 7 is a section view of the assembly of FIG. 1 showing the securing of the nut to complete the assembly.
Figure 8:
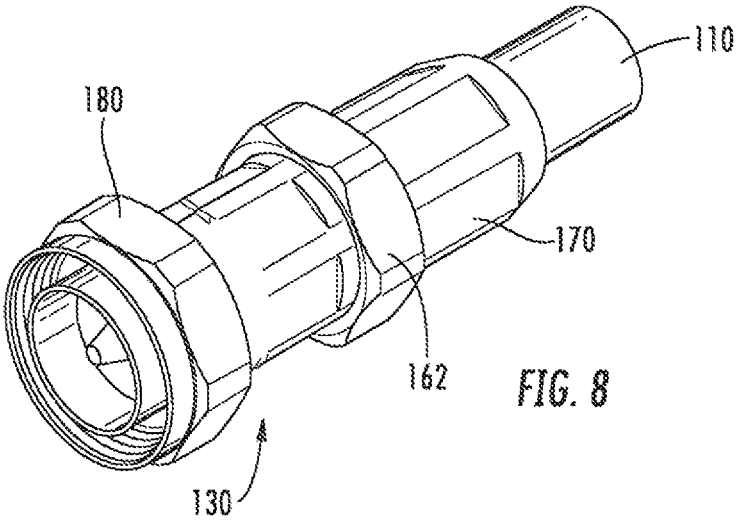
FIG. 8 is a perspective view of the assembly of FIG. 7.

Once the outer body 134 has been secured to the rear body 150, the nut 170 is tightened (see FIGS. 1 and 7). Rotation of the nut 170 causes the nut 170 to advance forwardly relative to the rear body 150 due to the interaction of the threaded section 172 and the threaded area 159. Advancement of the nut 170 causes the tapered inner surface 174 of the nut 170 to force the rear collet 157 radially inwardly onto the jacket 120 of the cable 110. The inward deflection of the rear collet 157 secures the jacket 120 relative to the rear body 150. The completed assembly 100 is shown in FIG. 8.

As can be seen in FIG. 7, four different O-rings are included to maintain a watertight seal for the electrical connections. An O-ring 190 is located in the recess 158 in the rear body 150 to provide a seal between the polymeric nut 170 and the rear body 150. An O-ring 192 is located in the recess 155 in the rear body 150 to provide a seal between the rear body 150 and the outer body 134. An O-ring 194 is located in the second endmost corrugation 116*b* in the outer conductor 116 to provide a seal between the rear body 150 and the outer conductor 116. Finally, an O-ring 196 is located in a recess in the tapered surface 174 of the polymeric nut 170 to provide a seal between the nut 170 and the jacket 120.

Figure 9:
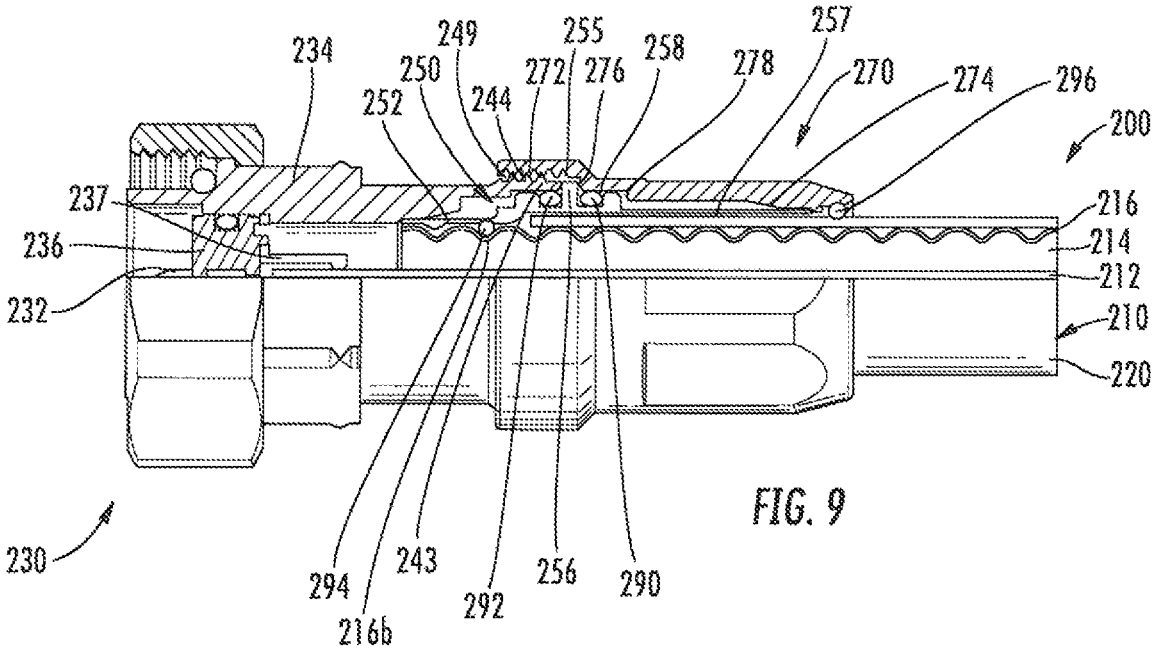
FIG. 9 is a partial section view of a coaxial connector-cable assembly according to additional embodiments of the invention.

Referring now to FIG. 9, another embodiment of a coaxial cable-connector assembly, designated broadly at 200, is illustrated therein. The assembly 200 includes a coaxial cable 210 that has an inner conductor 212, a dielectric layer 214, and a jacket 220 like those of the cable 110 discussed above. The connector 230 has an inner contact 232, an outer body 234, a dielectric spacer 236, and an insulator 237 that are similar to those of connector 130 above. The rear body 250 is very similar to the rear body 150 discussed above, with the exception that it lacks a threaded section on its outer surface, and the recess 258 is nearer to the recess 255. The polymer nut 270 has an interior threaded section 272 at one end and a tapered opposite end 274 as is the case with the polymer nut 170. However, the polymer nut 270 has a doubly-stepped profile, with two different internal shoulders 276, 278 between the threaded section 272 and the tapered end 274, and is somewhat longer than the polymer nut 170. The assembly 200 lacks the nut 162 of the assembly 100.

The assembly 200 is constructed by first preparing the cable 210 as discussed above. The rear body 250 and polymer nut 270 are slipped onto the cable 210, then the connector 230 is slipped onto the cable 210, and the polymer nut 270 is threaded onto the threaded section 244 of the tail 243 and rotated to advance the nut 270. The nut 270 is tightened until the tail 243 of the outer body 230 abuts the flange 256 of the rear body 250. Advancement of the nut 270 relative to the rear body 250 deflects the rear collet 257 into the cable jacket 220, and also deflects the front collet 252 into the outer conductor 216.

As is the case with the assembly 100, four different O-rings are included to maintain a watertight seal for the electrical connections. An O-ring 290 is located in the recess 258 in the rear body 250 to provide a seal between the polymeric nut 270 and the rear body 250. An O-ring 292 is located in the recess 255 in the rear body 250 to provide a seal between the rear body 250 and the outer body 234. An O-ring 294 is located in the second endmost corrugation 216*b* in the outer conductor 216 to provide a seal between the outer body 234 and the outer conductor 216. Lastly, an O-ring 296 is located in a recess in the tapered surface of the polymeric nut 270 to provide a seal between the nut 270 and the jacket 220.

Figure 10:
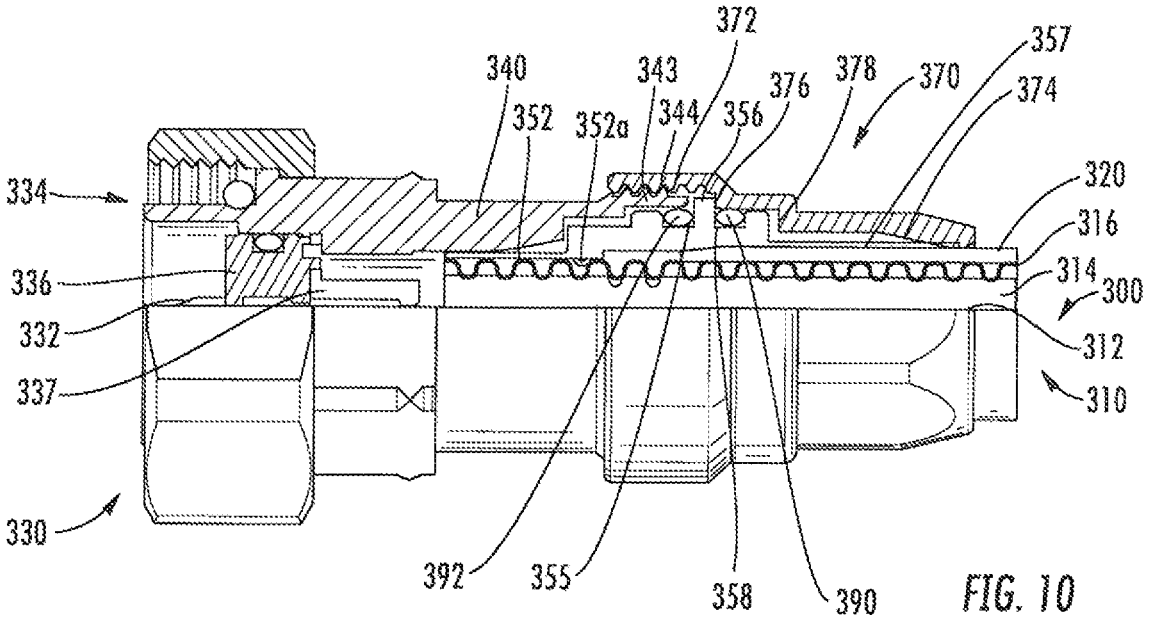
FIG. 10 is a partial section view of a coaxial connector-cable assembly according to further embodiments of the invention.
Figure 11:
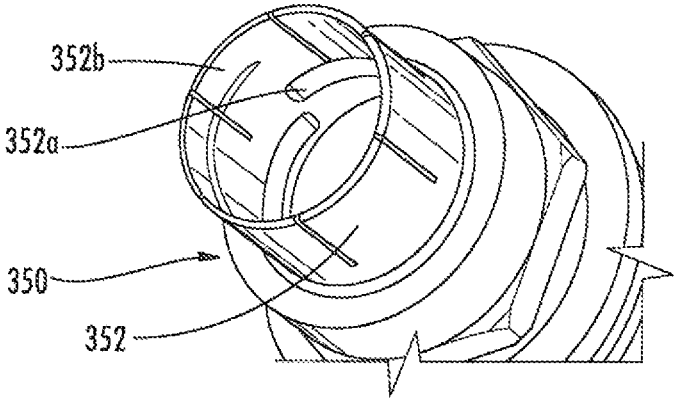
FIG. 11 is a perspective view of the rear body of the assembly of FIG. 10.
Figure 12:
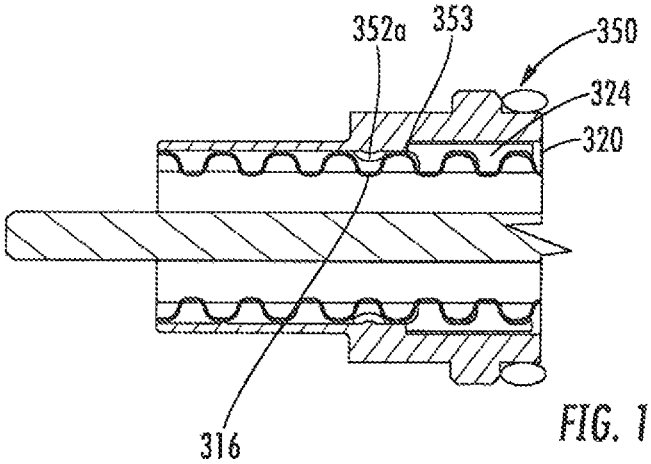
FIG. 12 is an enlarged side section view of the cable and rear body of the assembly of FIG. 10.

Referring now to FIGS. 10-12, another embodiment of a coaxial cable-connector assembly, designated broadly at 300, is illustrated therein. The assembly 300 includes a coaxial cable 310 that has an inner conductor 312, a dielectric layer 314, and a jacket 320 like those of the cables 110, 210 discussed above, but has a corrugated outer conductor 316 that has helical, rather than annular, corrugations. The connector 330 has an inner contact 332, a dielectric spacer 336, and an insulator 337 that are similar to those of connectors 130, 230 above, and an outer body 334 that is similar to the outer body 134 of the connector 130 with the exception that the outer wall of the main section 340 is stepped radially inwardly at its rear portion, as is the tail 343. The rear body 350 is very similar to the rear body 150 discussed above, with the exception that the nubs 352*a* on the fingers 3526 of the front collet 352 are arranged as a helix to match the corrugations of the outer conductor 316 (see FIG. 11). The polymeric nut 370 has a doubly-stepped profile like the nut 270, with two different internal shoulders 376, 378 along with the tapered rear inner surface 374 and the threaded area 372.

The assembly 340 is constructed by first preparing the cable 310 as discussed above, although as shown in FIGS. 10 and 12, the jacket 320 is stripped back somewhat farther, and an annular sealing plug 324 is inserted into the corrugations adjacent the end of the jacket 320. The rear body 350 and polymer nut 370 are slipped onto the cable 310 such that a shoulder 353 of the rear body 350 abuts the sealing plug 324; this positioning of the rear body 350 relative to the cable 310 should locate the nubs 352*a* within the corrugations of the outer conductor 316. The connector 330 is then slipped onto the cable 310, and the polymer nut 370 is threaded onto the threaded section 344 of the tail 343 and rotated to advance the nut 370. The nut 370 is tightened until the tail 343 of the outer body 330 abuts the flange 356 of the rear body 350. Advancement of the nut 370 relative to the rear body 150 deflects the rear collet 357 into the cable jacket 320, and also deflects the front collet 352 into the outer conductor 316.

Two O-rings and the sealing plug 324 provide full sealing for the assembly 300. An O-ring 390 is located in the recess 358 in the rear body 350 to provide a seal between the polymeric nut 370 and the rear body 350. An O-ring 392 is located in the recess 355 in the rear body 350 to provide a seal between the rear body 350 and the outer body 334. Finally, the sealing plug 324 provides a seal between the rear body 350 and the jacket 320.

Figure 13:
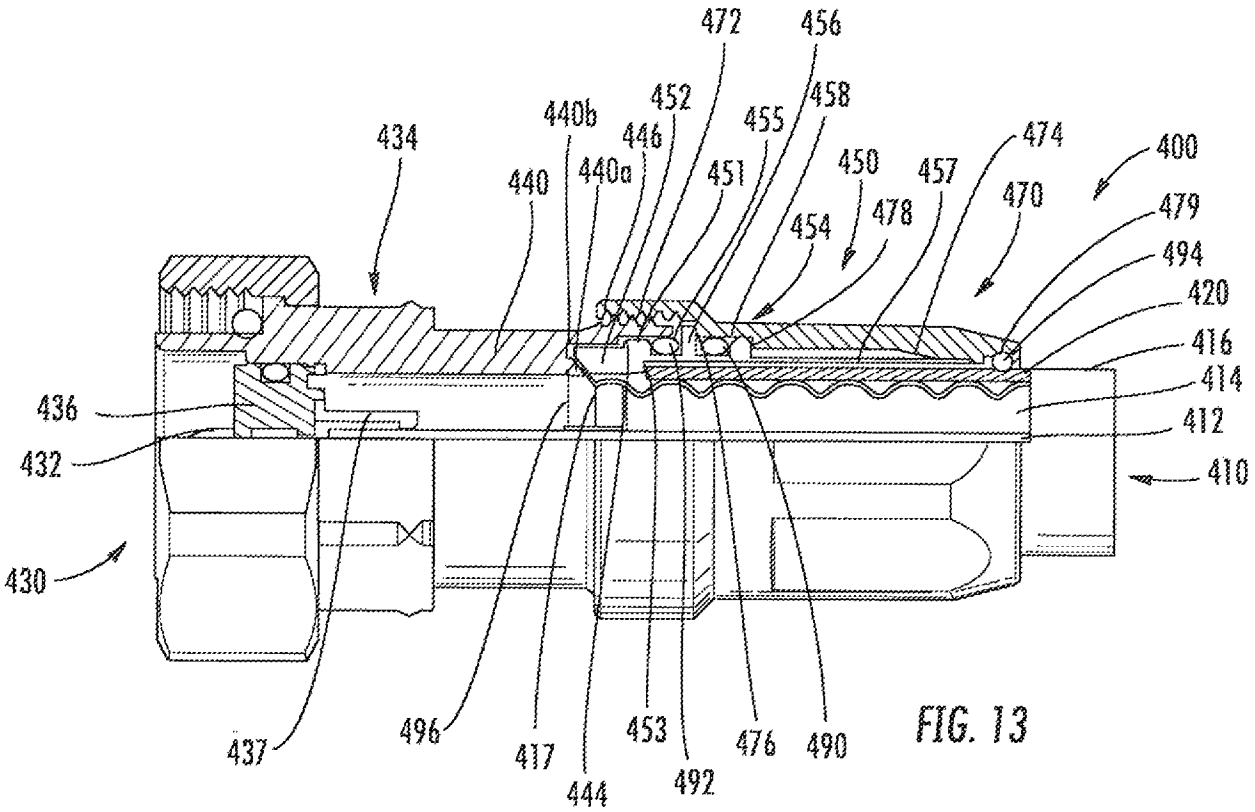
FIG. 13 is a partial section view of a coaxial connector-cable assembly according to still further embodiments of the invention.
Figure 14:
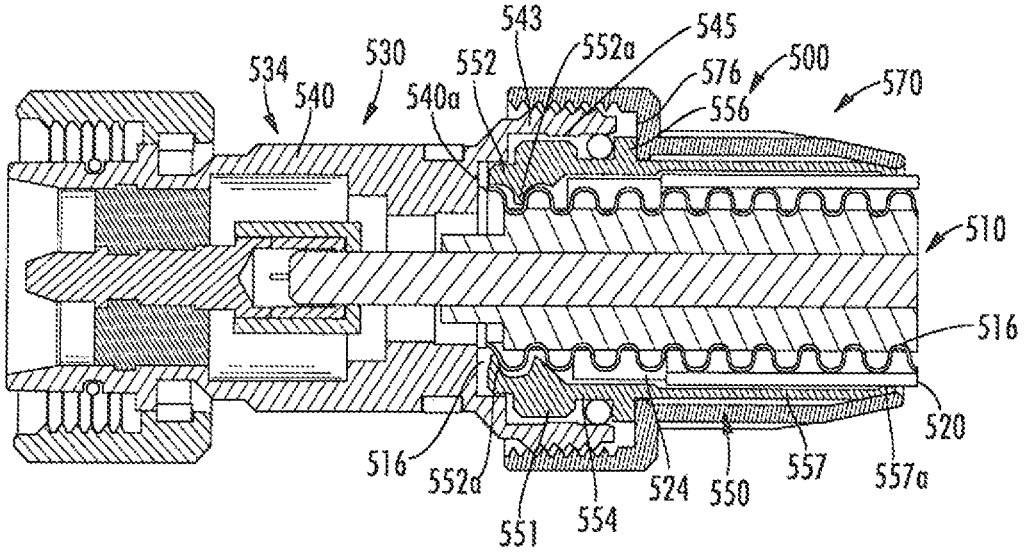
FIG. 14 is a partial section view of a coaxial connector-cable assembly according to even further embodiments of the invention.

FIG. 13 illustrates another embodiment of a coaxial cable-connector assembly, designated broadly at 400, that includes a cable 410, a connector 430, a rear body 450, and a polymeric nut 470. The cable 410 is similar to the cable 110 with the exception that the crest of the endmost corrugation 417 of the outer conductor 416 is flared radially outwardly. The inner contact 432, dielectric spacer 436 and insulator 437 of the connector 430 are similar to those of the connector 130. However, the main sleeve 440 of the outer body 434 differs somewhat from that of the outer body 134. Rather than having a tapered inner surface at its rear end, the main sleeve 440 has a projection 440*a* that extends radially inwardly and rearwardly to create a pocket 440*b*.

The rear body 450 differs in several ways from the rear body 150 and will therefore be described in greater detail. The rear body 450 has a main section 454 with two recesses 455, 458 on either side of a flange 456. A rear collet 457 extends rearwardly from the main section 454. A finger 452 protrudes forwardly of the main section 454; the finger 452 is wedge-shaped in cross-section and serves as an engagement structure with the outer body 434 in place of a front collet. A shoulder 453 is located rearwardly of the finger 452, and a hexagonal ring 451 is located radially outwardly of the shoulder 453.

The polymer nut 470 is similar to the polymer nut 270, with two different internal shoulders 476, 478 between the threaded section 472 and the tapered end 474.

As can be envisioned from FIG. 13, assembly begins with the preparation of the cable end as discussed above, which may also include flaring the endmost corrugation 417 of the outer conductor 416. The polymer nut/rear body assembly is then slipped onto the cable 410 until the end of the jacket 416 bottoms out against the shoulder 453. If the endmost corrugation 417 of the outer conductor 416 has not already been flared, it is next flared to rest adjacent the finger 452 of the rear body 450. The connector 430 is then slipped onto the cable 410, with the finger 452 and endmost corrugation 417 fitting within the pocket 440*b*. As with the rear body and outer body 150, 134, the connector 430 is aligned relative to the rear body 450 via interaction between the hex ring 451 and the hexagonal broach 444 of the outer body 434. The threaded section 472 of the polymer nut 470 is then threaded onto the threaded section 446 of the outer body 434 to force the outer body 434 and the rear body 450 toward each other as the shoulder 476 pushes against the flange 456; this movement ceases when the endmost corrugation 417 is fully compressed between the finger 452 and the pocket 440*b* and/or the tail 443 contacts the side of the flange 456 opposite the shoulder 476. In this position, the rear collet 457 is deflected by the tapered surface 474 of the polymer nut 470 to grip the jacket 420.

Once again, four O-rings provide full sealing for the assembly 400. An O-ring 490 is located in the recess 458 in the rear body 450 to provide a seal between the polymeric nut 470 and the rear body 450. An O-ring 492 is located in the recess 455 in the rear body 450 to provide a seal between the rear body 450 and the outer body 434. An O-ring 494 is located in a recess 479 in the polymer nut 470 to provide a seal between the polymer nut 470 and the jacket 420. An O-ring 496 is located in the root of the flared corrugation 417 to provide a seal between the rear body 450 and the outer conductor 416.

Referring now to FIGS. 14-17, another assembly, designated broadly at 500, is illustrated therein and includes a cable 510, a connector 530, a rear body 550, and a polymeric nut 570. The polymeric nut 570 is similar to the polymeric nut 470 with the exception that it has a single-stepped profile with one internal shoulder 576. The rear body 550 is similar to the rear body 450 of FIG. 13 with the exceptions that (a) the rear collet 557 extends along the cable jacket 520 virtually the full length of the polymeric nut 570 and has a nub 557*a* on its inner surface, (b) in the main section 554, the hex ring 551 extends rearwardly a greater length, and there is only one flange 556, and (c) the finger 552 has a bevelled front surface with a helical protrusion 552*a* extending radially inwardly. The connector 530 is similar to the connector 430 with the exceptions that (a) the main sleeve 540 of the outer body 534 has a flat shoulder 540*a*, and (b) the inner surface of the tail 543 of the outer body 534 has a "12 point socket" 545 (see FIG. 15) on its radially inward surface. Also, a sealing plug 524 is present between the rear body 550 and the outer conductor 516 of the cable 510.

Figure 15:
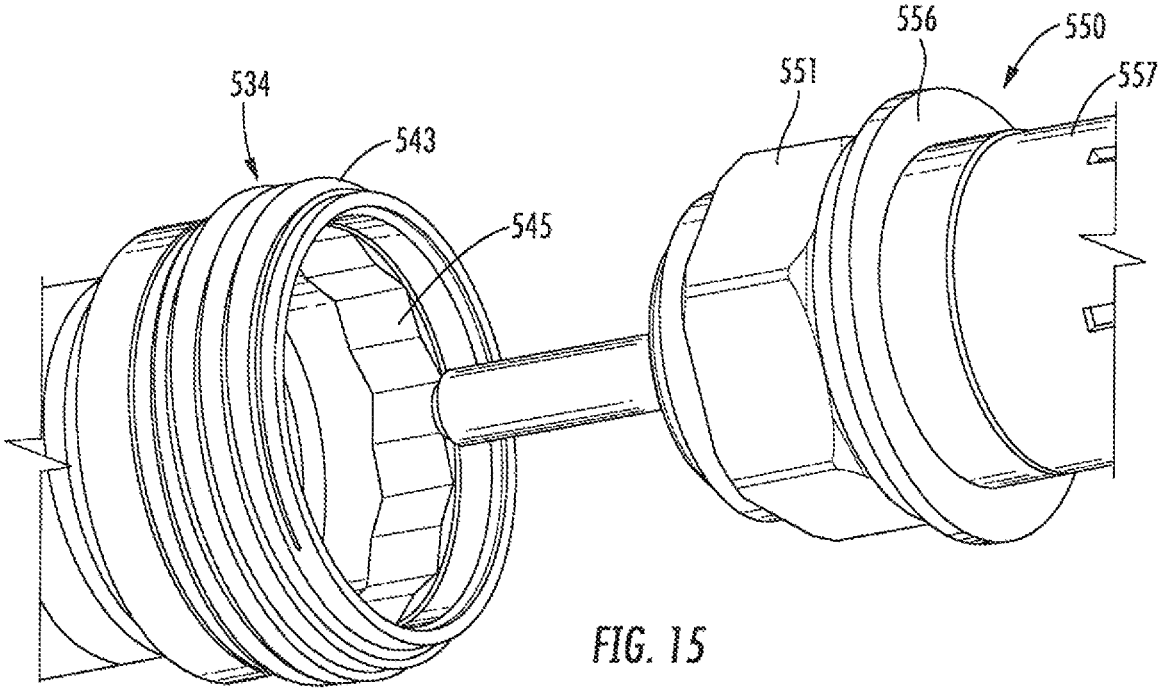
FIG. 15 is an enlarged exploded perspective view of the collet and outer conductor body of the assembly of FIG. 14.
Figure 16:
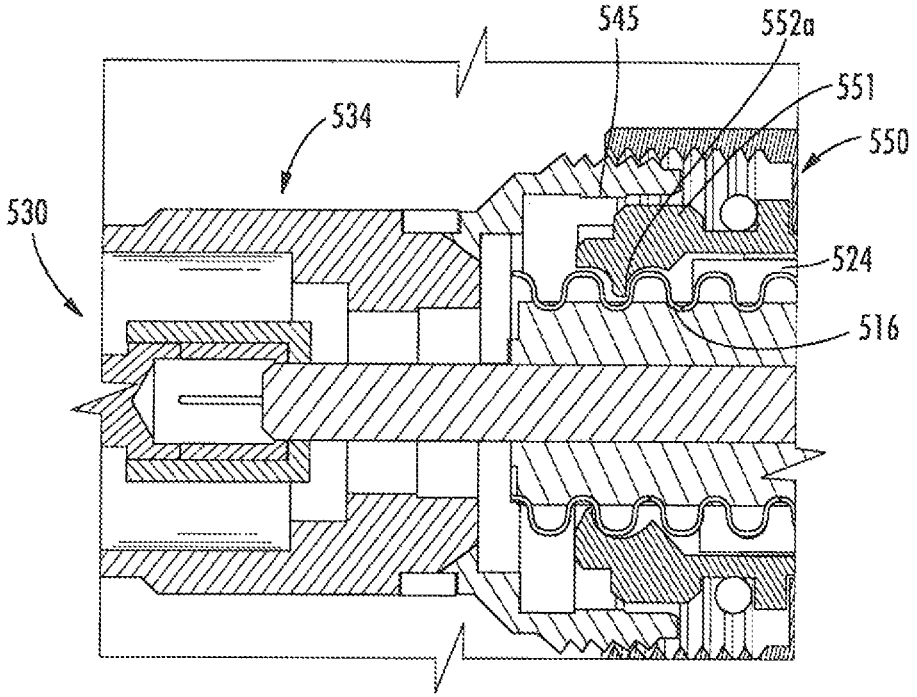
FIG. 16 is a partial section view of the assembly of FIG. 14 with the cable in position for insertion into the outer connector body.
Figure 17:
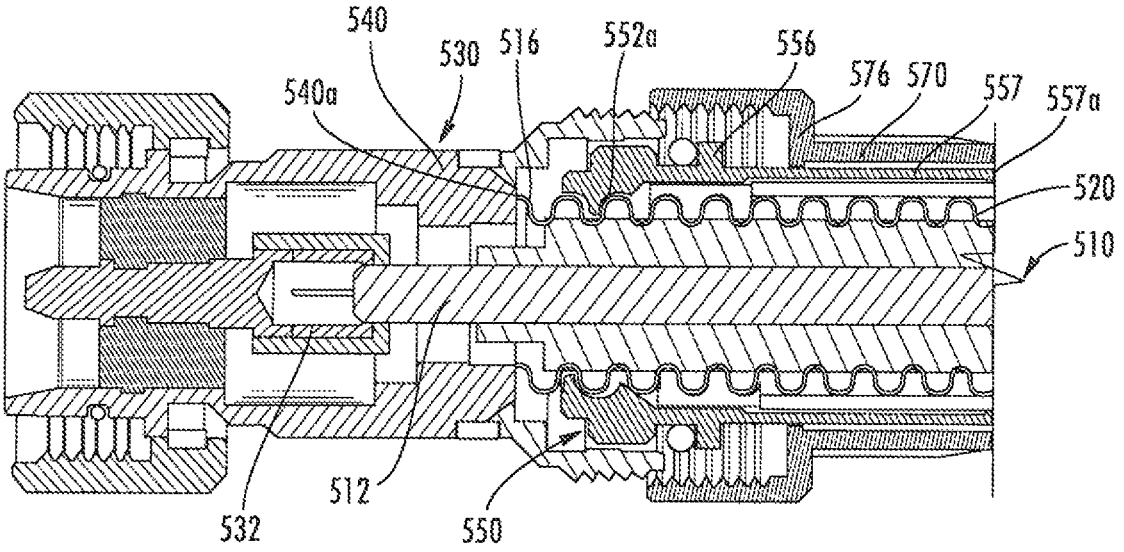
FIG. 17 is a partial section view of the assembly of FIG. 14 with the cable partially inserted into the outer connector body.
Figure 18:
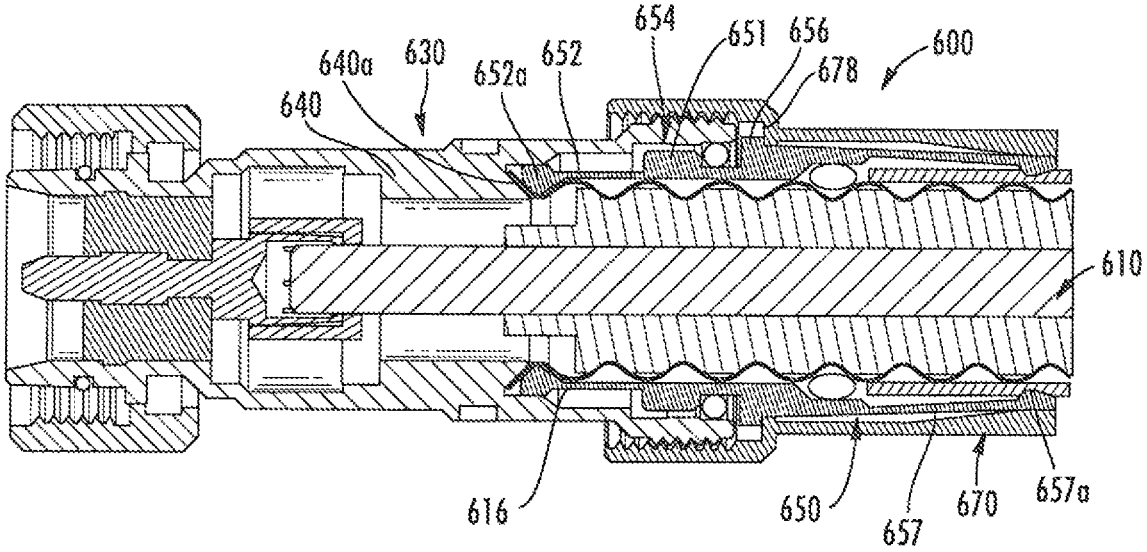
FIG. 18 is a partial section view of a coaxial connector-cable assembly according to still further embodiments of the invention.
Figure 19:
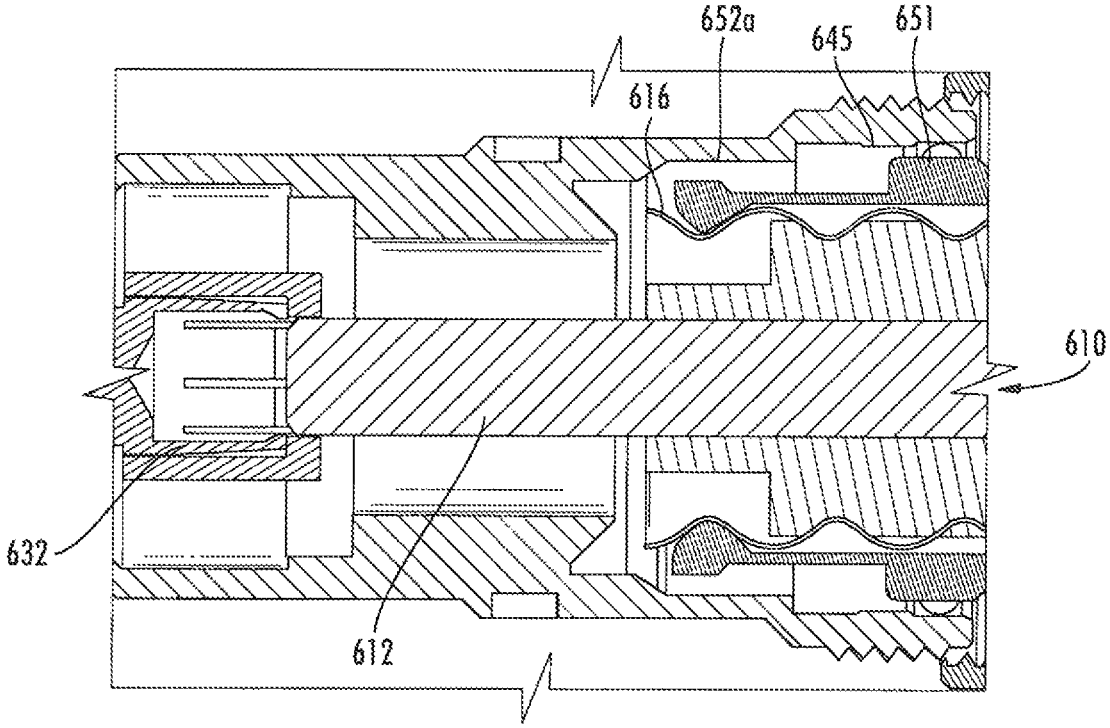
FIG. 19 is an enlarged partial section view of the assembly of FIG. 18 with the cable in position for insertion into the outer connector body.
Figure 20:
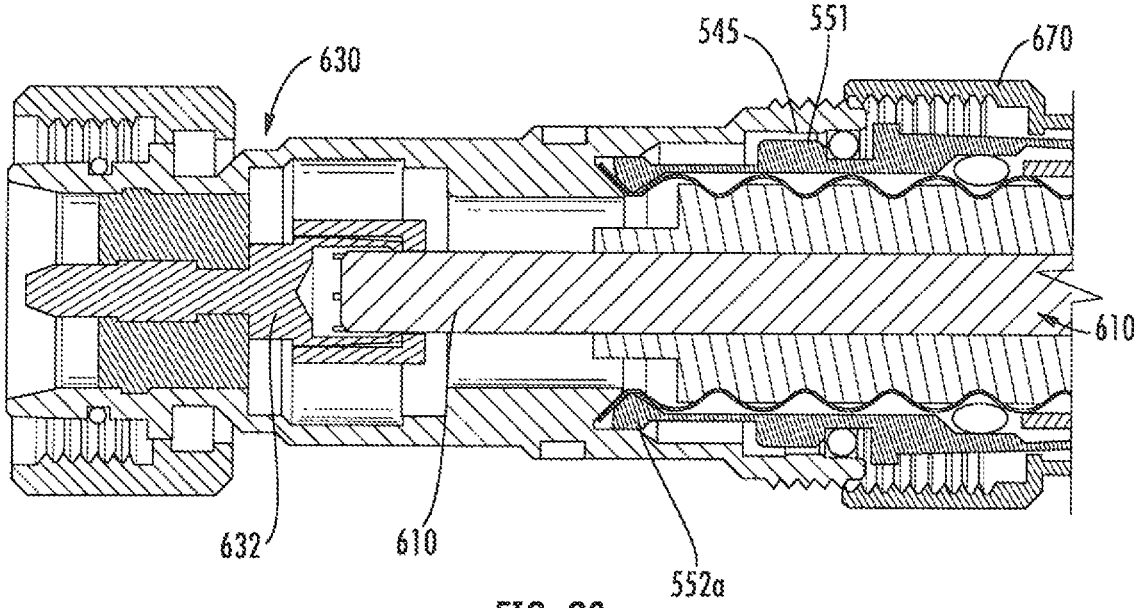
FIG. 20 is a partial section view of the assembly of FIG. 18 with the cable partially inserted into the outer connector body.
Figure 21:
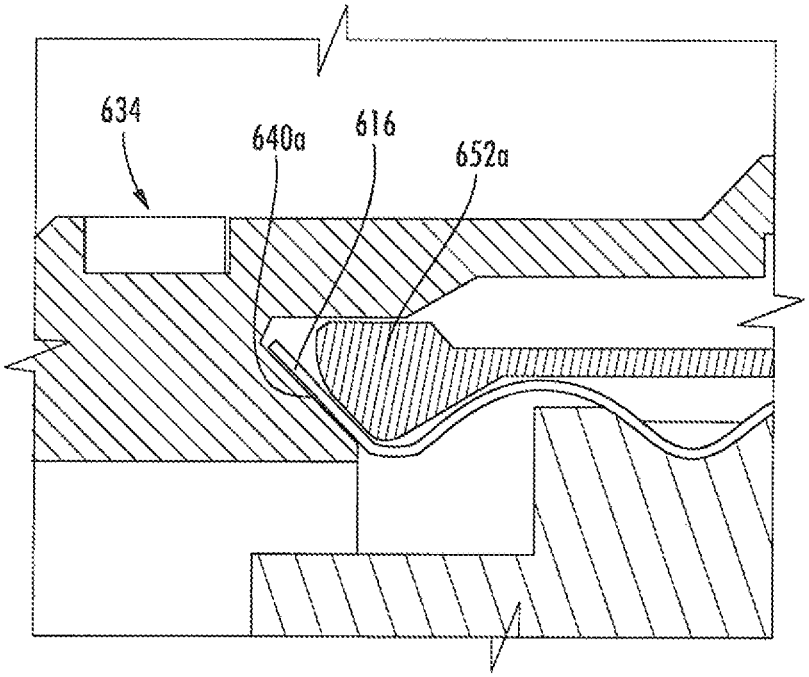
FIG. 21 is a greatly enlarged partial view of the assembly of FIG. 18 showing the clamping of the flared end of the outer conductor with the collet.

Referring to FIGS. 15-17, the assembly 500 is constructed by slipping the rear body 550 and the polymeric nut 570 onto to the cable 510. The rear collet 557 overlies the jacket 520 of the cable 510, the main section 554 overlies the sealing plug 524, and the protrusion 552*a* is threaded onto the outer conductor 516 such that one or more of the helical corrugations (approximately 3 mm) of the outer conductor 516 extends forwardly of the rear body 550. The cable 510 and rear body 550 are then inserted into the bore of the connector 530 (see FIG. 15). The connector 530 may be rotated slightly so that the hex ring 551 of the rear body 550 fits within the 12 point socket 545 of the outer conductor body 534 of the connector 530 (see FIG. 16). Once the hex ring 551 of the rear body 550 is fitted within the 12 point socket 545, the electrical contact surfaces of the rear body 550, the connector 530, and the cable 510 do not rotate relative to each other during mating, such that electrical performance may be improved due to the absence of PIM-generating residue and the like on the contact surfaces. The polymeric nut 570 is then rotated relative to the cable 510, the rear body 550, and the connector 530. The shoulder 576 of the nut 570 engages the flange 556 of the rear body 550, forcing it forward, which in turn advances the inner conductor 512 of the cable 510 into the inner contact 532 of the connector 530. In addition, forward movement of the rear body 550 (and its protrusion 552*a*) forces the forward end of the outer conductor 516 forward, which crushes the endmost corrugation(s) against the inner shoulder 540*a* of the main sleeve 540 of the outer conductor body 534 to establish electrical contact. Further, advancement of the nut 570 also forces the nub 557*a* of the rear collet 557 into the jacket 520 to clamp the rear body 550 onto the jacket 520 (and in turn secure the connector 530 onto the end of the cable 510 (compare FIGS. 14 and 17).

Referring now to FIGS. 18-22, another embodiment of a cable-connector assembly, designated broadly at 600, is shown therein. The assembly 600, which is somewhat similar to the assembly 500, includes a cable 610, a connector 630, a rear body 650, and a polymeric nut 670. The cable 610 is similar to the cable 510, but with the outer conductor 516 having annular corrugations with a flared end. The polymeric nut 670 is similar to the nut 570, with a single-step profile with a shoulder 678. The rear body 650 is similar to the rear body 450 of the assembly 450, but the main section 654 includes a hex ring 651 and a flange 656 similar to those of rear body 550 above. Also, the rear body 650 includes a front collet 652 with a wedge-shaped ramp 652*a* at its forward end. The connector 630 is similar to the connector 530, but has an angled surface 640*a* at the rearward end of the main sleeve 640.

Figures 22A, 22B, 22C:
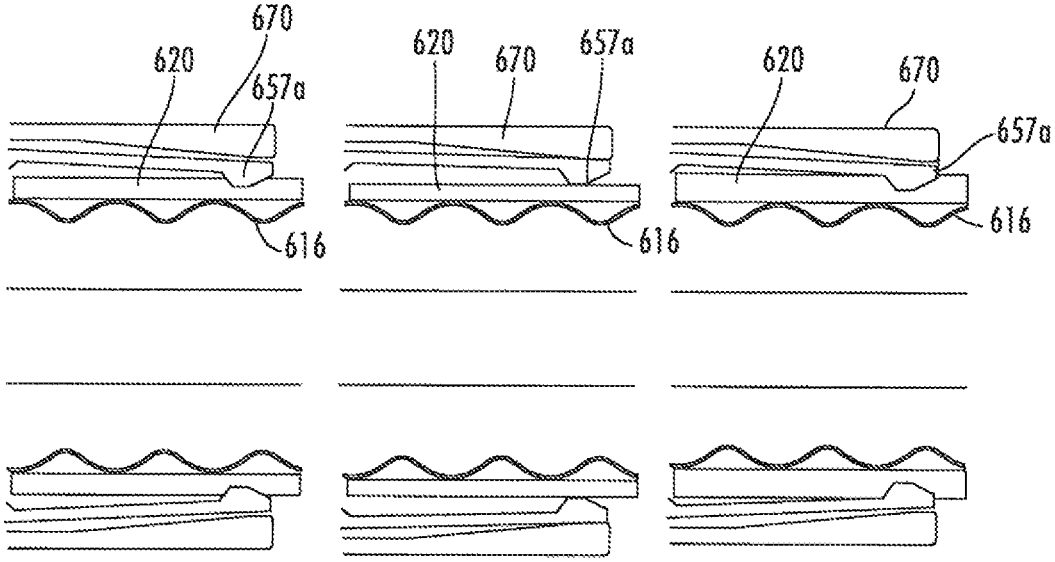
FIGS. 22A-22C are three partial section views of the end of the collet of the assembly of FIG. 18 showing how the end of the collet can adapt to clamp to different thicknesses of cable jacket.

To construct the assembly 600, the rear body 650 and coupling nut 670 are slipped onto the cable 610. The ramp 652*a* fits within the endmost corrugation of the outer conductor 616 (see FIG. 19). The connector 630 is then inserted onto the rear body 650 and cable 610; as described above with respect to the assembly 500, the connector 630 may be rotated slightly so that the hex ring 651 of the rear body 650 aligns with the 12-point socket 645 of the connector 630, thereby preventing insertion of the inner conductor 612 of the cable 610 into the inner contact 632 of the connector 630 until the parts are properly aligned (see FIG. 20, wherein the inner conductor 612 is partially inserted into the inner contact 632). The polymeric nut 670 is then rotated relative to the rear body 650, the connector 630 and the cable 610, which both clamps the nub 657*a* of the rear collet 657 into the jacket 620 (see FIG. 18) and forces the flared end of the outer conductor 616 into the angled surface 640*a* of the outer conductor body 634 (see FIG. 21). FIGS. 22A-22C show how the nub 657*a* can provide clamping and sealing with different thicknesses of jackets 620, and also shows that the nub 657*a* is positioned just on the rearward side of one of the crests of the corrugations of the outer conductor 616 to allow the jacket 620 to flex if necessary.

Figure 23:
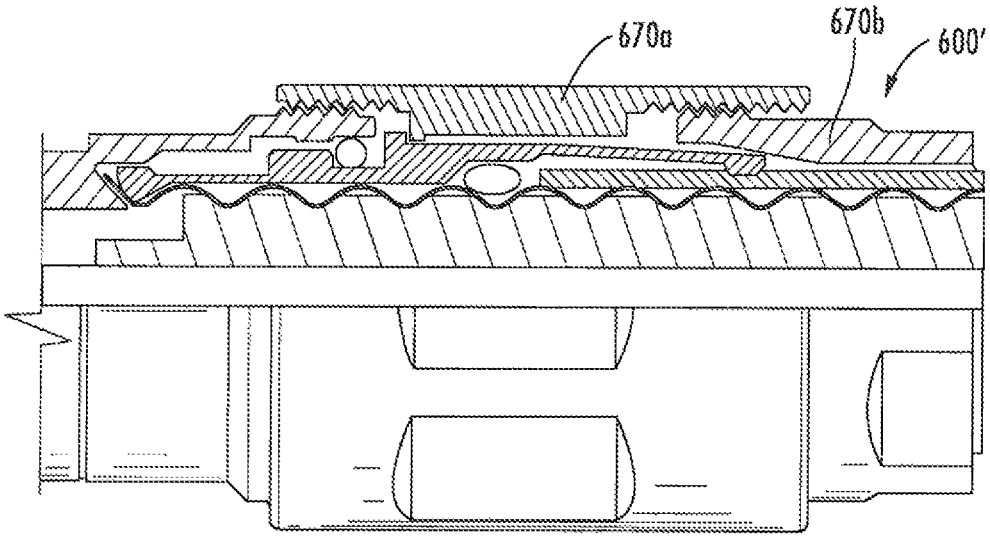
FIG. 23 is a partial section view of an alternative embodiment of an assembly of FIG. 18 with the coupling nut being separated into two pieces that are threaded together.

Referring now to FIG. 23, an alternative embodiment of an assembly, designated broadly at 600', employs two nuts 670*a*, 670*b* in place of the single polymeric nut 670. This alternative may be beneficial if jacket thickness varies sufficiently that PIM and/or return loss may be compromised.

Those skilled in this art will appreciate that the connectors and their components may take different forms. For example, the hex rings and 12-point sockets employed in the connectors 530, 630 may be replaced with other mating combinations (e.g., 6-point hex ring and 6-point socket, 12-point ring and 12-point socket, 5-point pentagonal ring and 10-point socket, etc.) that can prevent relative rotation of the outer conductor body and the rear body. Other combinations will be apparent to those of skill in this art.

Figure 24:
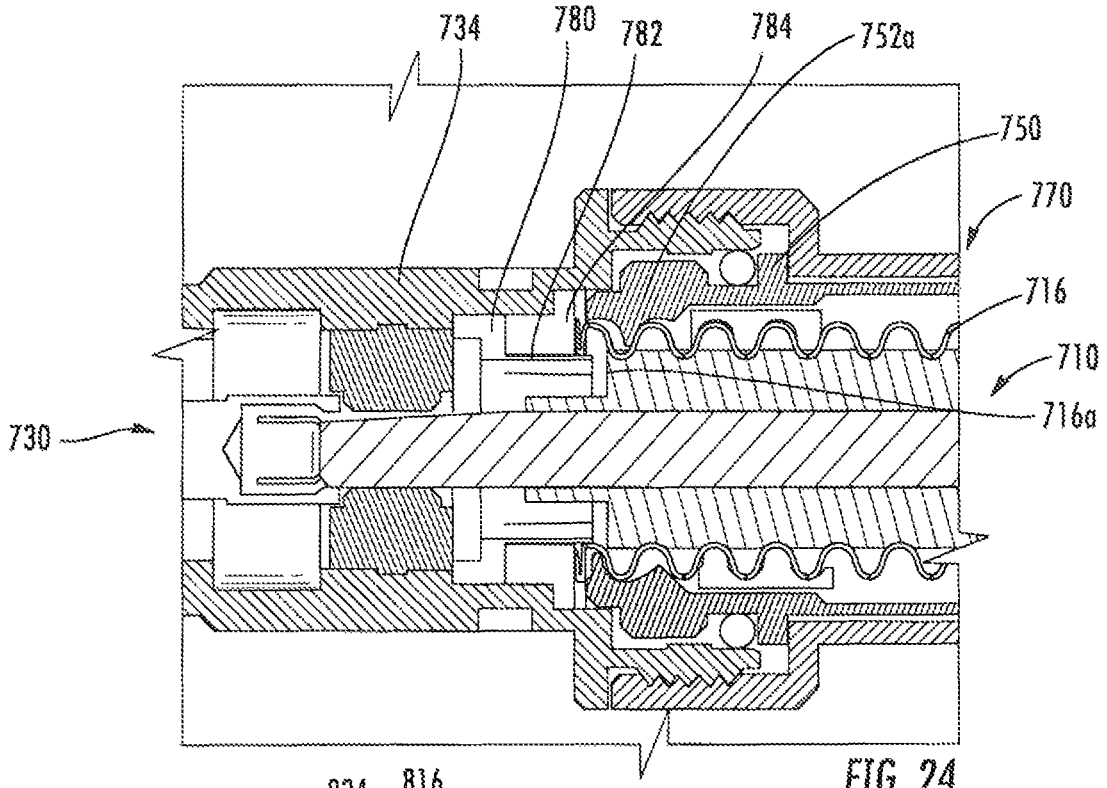
FIG. 24 is a partial section view of a coaxial connector-cable assembly according to still further embodiments of the invention.

Referring now to FIG. 24, another alternative embodiment of a coaxial connector-cable assembly, designated broadly at 700, is shown therein. The assembly 700 is similar to the assembly 500 described above and illustrated in FIGS. 14-17 and includes a cable 710, a connector 730, a rear body 750, and a polymeric nut 770. However, the connector 730 has an outer conductor body 734 that does not provide a surface against which the endmost corrugation 716*a* is crushed; instead, the connector 730 includes an annular insert 784 that provides a surface against which the endmost corrugation 716*a* is crushed when the rear body 750 is advanced (via the projection 752*a* inserted into one of the corrugations of the outer conductor 716), and further includes a spring basket 780 with tines 782. As can be seen in FIG. 24, the endmost corrugation 716*a* extends radially inwardly and makes electrical contact with the radially outward surfaces of the tines 782 of the spring basket 780. Also, a positive stop is created between the coupling nut 770, the rear body 750 and the outer conductor body 734. Because the electrical contact between the outer conductor 716 of the cable 710 and the outer conductor body 734 is radial, rather than axial, avoidance of PIM can become more reliable, as the magnitude of the torque applied to the coupling nut 770 becomes less critical. As a result, the coupling nut 770 may be tightened to the positive stop with an ordinary tool rather than a torque wrench, which can be more unwieldy and less predictable in generating a PIM-free connection.

Figure 25:
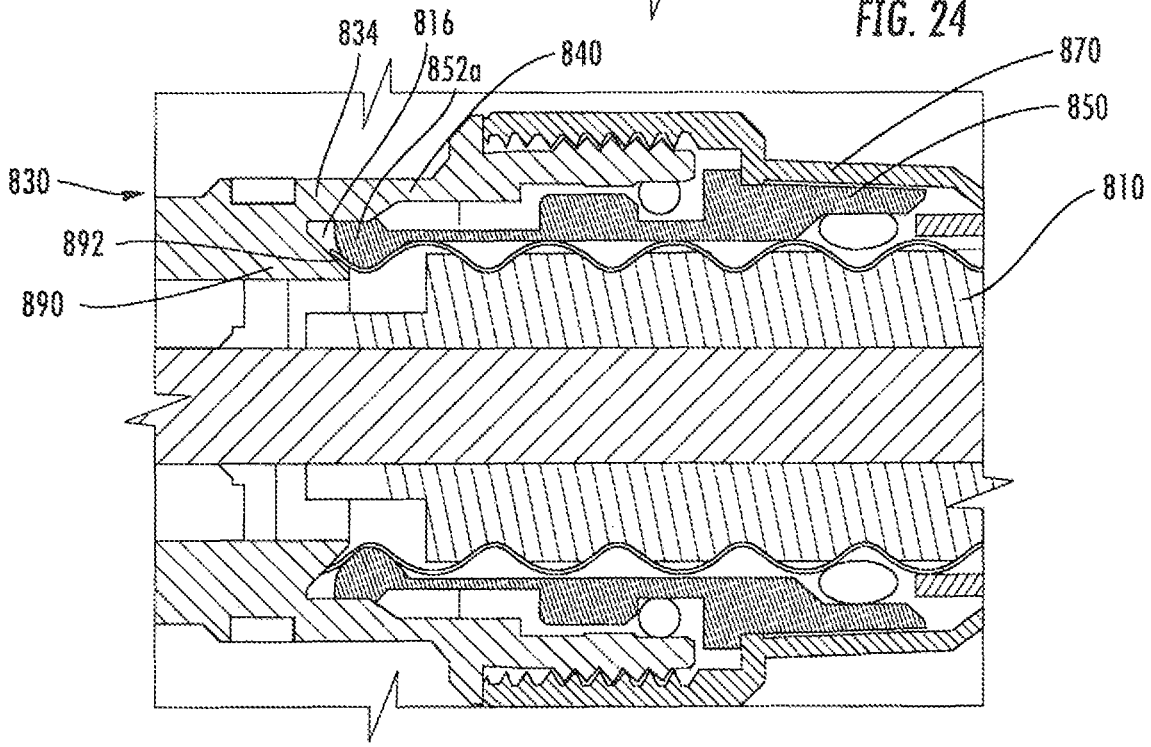
FIG. 25 is a partial section view of a coaxial connector-cable assembly according to yet further embodiments of the invention.

Referring now to FIG. 25, a further alternative embodiment of a coaxial connector-cable assembly, designated broadly at 800, is shown therein. The assembly 800 is similar to that illustrated in FIGS. 18-22 and includes a cable 810, a connector 830, a rear body 850, and a polymeric nut 870. However, the connector 830 includes an annular insert 890 with an angled surface 892 against which the ramp 852*a* compresses the flared end of the outer conductor 816 of the cable 810. Also, the main sleeve 840 of the outer conductor body 834 is narrower, which provides more room for the ramp 852*a* (which is located at the end of each tine of the front collet 852) to deflect radially outwardly. The nut 870, outer conductor body 834 and rear body 850 create a positive stop when the nut 870 is tightened. The ability of the ramp 852*a* to deflect outwardly can help to maintain sound electrical contact (with reduced or minimal PIM) between the outer conductor 816 and the insert 890 even with looser tolerances of the outer conductor 816 and other components, which can enable the use of the aforementioned positive stop rather than having to rely on a torque wrench.

It should be noted that certain features of the assemblies described above may be omitted and/or included in other embodiments. For example, the radial engagement of the endmost corrugation of the outer conductor with a spring basket shown in FIG. 24 may be employed in an assembly that does not include the anti-rotation features (i.e., the hex ring and 12-point socket) illustrated in FIGS. 14-17. Similarly, the outward deflection of the tines of the front collet shown in FIG. 25 may be employed in an assembly that does not include the anti-rotation features shown in FIGS. 18-23. Other variations are also possible.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable-connector assembly, comprising:

(a) a coaxial cable, comprising:

an inner conductor;

a dielectric layer circumferentially surrounding the inner conductor;

an outer conductor circumferentially surrounding the dielectric layer, the outer conductor including corrugations; and a jacket circumferentially surrounding the outer conductor;

(b) a coaxial connector, comprising:

an inner contact electrically connected with the inner conductor;

an outer body spaced apart from and circumferentially surrounding the inner contact; and a dielectric spacer interposed between the inner contact and the outer body;

(c) a rear body having a main section, a rear collet extending rearwardly from the main section, and a front engagement structure that coordinates with the outer body to engage the outer conductor, wherein the rear collet includes a plurality of fingers; and (d) a nut having a threaded section and a tapered inner surface;

wherein engagement of the nut with a threaded section on the rear body advances the nut forwardly so that the tapered inner surface of the nut deflects the rear collet to engage the cable jacket; and wherein the front engagement structure is configured to both engage a corrugation of the outer conductor and clamp a flared end of the outer conductor against the outer body.

2. The assembly defined in claim 1, wherein the rear body includes a front collet, and wherein the engagement structure is carried on the front collet.

3. The assembly defined in claim 1, wherein the engagement structure includes a nub that engages the corrugation of the outer conductor.

4. The assembly defined in claim 1, wherein the outer body and the rear body have mating structures that prevent relative rotation therebetween.

5. The assembly defined in claim 4, wherein the mating structures comprise a multi-point ring on the rear body and a matable multi-point point socket on the outer body.

6. The assembly defined in claim 1, wherein the rear body includes a radially-outwardly extending flange, and wherein a tail of the outer body engages the flange.

7. The assembly defined in claim 6, wherein the nut engages the flange.

8. The assembly defined in claim 1, wherein the threaded section on the nut is an internal threaded section.

9. The assembly defined in claim 1, wherein the rear collet includes a radially-inward nub that engages the cable jacket.

10. A coaxial cable-connector assembly, comprising:

(a) a coaxial cable, comprising:

an inner conductor;

a dielectric layer circumferentially surrounding the inner conductor;

an outer conductor circumferentially surrounding the dielectric layer, the outer conductor including corrugations; and a jacket circumferentially surrounding the outer conductor;

(c) a coaxial connector, comprising:

an inner contact electrically connected with the inner conductor;

an outer body spaced apart from and circumferentially surrounding the inner contact; and a dielectric spacer interposed between the inner contact and the outer body;

(c) a rear body having a main section, a rear collet extending rearwardly from the main section, and a front engagement structure that coordinates with the outer body to engage the outer conductor, wherein the rear collet includes a plurality of fingers; and (d) a nut having a threaded section and a tapered inner surface;

wherein engagement of the nut with a threaded section on the rear body advances the nut forwardly so that the tapered inner surface of the nut deflects the rear collet to engage the cable jacket; and wherein the front engagement structure includes a radially-inward projection that engages a non-endmost corrugation of the outer conductor.

11. The assembly defined in claim 10, wherein the rear body includes a front collet, and wherein the engagement structure is carried on the front collet.

12. The assembly defined in claim 10, wherein the outer body and the rear body have mating structures that prevent relative rotation therebetween.

13. The assembly defined in claim 12, wherein the mating structures comprise a multi-point ring on the rear body and a matable multi-point point socket on the outer body.

14. The assembly defined in claim 10, wherein the rear body includes a radially-outwardly extending flange, and wherein a tail of the outer body engages the flange.

15. The assembly defined in claim 14, wherein the nut engages the flange.

16. The assembly defined in claim 10, wherein the threaded section on the nut is an internal threaded section.

* * * * *